United States Patent [19]

Haugsjaa et al.

[11] 4,189,661

[45] Feb. 19, 1980

[54] ELECTRODELESS FLUORESCENT LIGHT SOURCE

[75] Inventors: Paul O. Haugsjaa, Acton; Edward F. White, Dorchester, both of Mass.

[73] Assignee: GTE Laboratories Incorporated, Waltham, Mass.

[21] Appl. No.: 959,823

[22] Filed: Nov. 13, 1978

[51] Int. Cl.[2] ..... H05B 41/24; H01J 65/04

[52] U.S. Cl. ..... 315/39; 315/248

[58] Field of Search ..... 315/39, 248

[56] References Cited

U.S. PATENT DOCUMENTS

| | | | |
|---|---|---|---|
| 3,942,058 | 3/1976 | Haugsjaa et al. | 315/39 X |
| 3,942,068 | 3/1976 | Haugsjaa et al. | 315/39 |
| 3,943,401 | 3/1976 | Haugsjaa et al. | 315/39 |
| 3,943,402 | 3/1976 | Haugsjaa et al. | 315/39 |
| 3,943,403 | 3/1976 | Haugsjaa et al. | 315/39 |
| 3,943,404 | 3/1976 | McNeil et al. | 315/39 |
| 3,993,927 | 11/1976 | Haugsjaa et al. | 315/39 |
| 3,995,195 | 11/1976 | Haugsjaa et al. | 315/58 |
| 3,997,816 | 12/1976 | Haugsjaa et al. | 315/267 |
| 4,001,631 | 1/1977 | McNeil et al. | 315/39 |
| 4,001,632 | 1/1977 | Haugsjaa et al. | 315/39 |
| 4,002,944 | 1/1977 | McNeil et al. | 315/39 |
| 4,005,330 | 1/1977 | Glascock et al. | 315/267 X |
| 4,010,400 | 3/1977 | Hollister | 315/248 |
| 4,041,352 | 8/1977 | McNeil et al. | 315/248 |
| 4,053,814 | 10/1977 | Regan et al. | 315/248 |
| 4,063,132 | 12/1977 | Proud et al. | 315/248 |
| 4,065,701 | 12/1977 | Haugsjaa et al. | 315/248 |
| 4,070,603 | 1/1978 | Regan et al. | 315/248 |

*Primary Examiner*—Alfred E. Smith
*Assistant Examiner*—Charles F. Roberts
*Attorney, Agent, or Firm*—William McClellan; Fred Fisher

[57] ABSTRACT

An electrodeless fluorescent light source has an electrodeless lamp mounted in a termination fixture which includes an inner conductor and an outer conductor disposed around the inner conductor and is coupled to a high frequency power source. Power is coupled to an ultraviolet-producing low pressure discharge in the electrodeless lamp which acts as a termination load within the termination fixture. A phosphor coating on the inner surface of the electrodeless lamp emits visible light upon excitation by ultraviolet radiation. Alternatively, the phosphor coating can be on the inner surface of a transparent envelope which forms part of the termination fixture. In this case, the phosphor coated envelope can be removable from the light source. The light source can be dimmed by reducing the microwave power input. Frequency of operation is typically from 902 MHz to 928 MHz.

14 Claims, 2 Drawing Figures

ELECTRODELESS FLUORESCENT LIGHT SOURCE

BACKGROUND OF THE INVENTION

This invention relates to electromagnetic discharge apparatus and more particularly to electrodeless fluorescent light sources in which a low pressure mercury discharge contained in a phosphor coated envelope is excited by high frequency power in a termination fixture.

Conventional high brightness fluorescent lamps provide long life and efficient operation but require large, heavy, and expensive ballasting circuits for operation at line frequencies. Conversion to high frequency operation to reduce the size of ballasting circuits does not eliminate the problem because of the cost of discrete components and magnetic materials used in these circuits. An additional problem as one attempts to make small fluorescent lamps is that power losses connected with the electrodes become an increasingly large fraction of the applied power.

Hollister has shown a technique for excitation of phosphor coated low pressure electrodeless lamps in U.S. Pat. No. 4,010,400 issued Mar. 1, 1977.

According to Hollister's patent, radio frequency power, typically at a frequency of 4 MHz, is coupled to a discharge medium contained in a phosphor coated envelope by an induction coil connected to a radio frequency source. Upon excitation, the discharge medium emits radiation which in turn causes excitation of the phosphor to produce visible light. One drawback of this approach is that several relatively expensive discrete components, in particular the induction coil, are required. Furthermore, the induction coil acts as an antenna and produces a considerable amount of RFI (Radio Frequency Interference). Optically transparent shielding is relatively difficult in this frequency range. Moreover, allowable tolerances on operating frequencies as required by the FCC are low for the frequencies used by Hollister and may require the use of crystal controlled oscillators.

Electrodeless light sources which operate by coupling high frequency power, typically 915 MHz, to a high pressure arc discharge in an electrodeless lamp have been developed. These light sources typically include a high frequency power source connected to a termination fixture with an inner conductor and an outer conductor surrounding the inner conductor as described in U.S. Pat. No. 3,942,058 issued Mar. 2, 1976 to Haugsjaa et al. and U.S. Pat. No. 3,942,068 issued Mar. 2, 1976 to Haugsjaa et al. The electrodeless lamp is positioned at the end of the inner conductor and acts as a termination load for the fixture. The termination fixture has the function of matching the impedance of the electrodeless lamp during high pressure discharge to the output impedance of the high frequency power source. Thus, when the high pressure discharge reaches steady state, a high percentage of input high frequency power is absorbed by the discharge in the electrodeless lamp. One method of constructing a termination fixture which matches the electrodeless lamp to the power source is shown in U.S. Pat. No. 3,943,403 issued Mar. 9, 1976 to Haugsjaa et al. The inner conductor has a length equal to one quarter wavelength at the operating frequency. Located at the source end of the termination fixture, or one quarter wavelength from the electrodeless lamp, is a capacitor which compensates for the reactive component of the lamp impedance. The dimensions of the termination fixture are such that the complex electrodeless lamp impedance is matched to the source impedance. Another method of constructing a termination fixture which matches the electrodeless lamp to the power source is shown in U.S. Pat. No. 3,943,404 issued Mar. 9, 1976 to McNeill et al. A helical coil couples the inner conductor to the electrodeless lamp and compensates for the reactive component of the electrodeless lamp impedance.

Since the high pressure arc discharge provides usable light output directly, both the electrodeless lamp and the termination fixture must be capable of transmitting visible light. The light transmitting portion of the termination fixture typically includes a transparent dome covered with a conductive mesh. At the frequency of operation, typically 915 MHz, a fine mesh is effective as an RFI shield, and little of the light output is blocked. By contrast, at lower frequencies of operation, such as those disclosed in the Hollister patent, a heavier conductive mesh is required to accomplish effective shielding because of the reduced skin effect at lower frequencies. A heavier conductive mesh is undesirable not only because more light output is blocked, but also because the cost is increased.

While high pressure electrodeless lamps powered by high frequency power in a termination fixture give generally satisfactory results and have extremely long life, these light sources have certain disadvantages. Starting is relatively slow and several seconds may be required to reach full light output. In addition, starting assist devices are required to initiate the discharge as shown in U.S. Pat. No. 3,997,816 issued Dec. 14, 1976 to Haugsjaa et al., U.S. Pat. No. 4,041,352 issued Aug. 9, 1977 to McNeill et al., and U.S. Pat. No. 4,053,814 issued Oct. 11, 1977 to Regan et al.

The following United States patents relate generally to electrodeless light sources utilizing a high pressure discharge in a termination fixture and may be of interest.

| U.S. Pat. No. | Patentee | Issue Date |
|---|---|---|
| 3,943,401 | Haugsjaa et al | March 9, 1976 |
| 3,943,402 | Haugsjaa et al | March 9, 1976 |
| 3,993,927 | Haugsjaa et al | Nov. 23, 1976 |
| 3,995,195 | Haugsjaa et al | Nov. 30, 1976 |
| 4,001,631 | McNeill et al | Jan. 4, 1977 |
| 4,001,632 | Haugsjaa et al | Jan. 4, 1977 |
| 4,002,944 | McNeill et al | Jan. 11, 1977 |
| 4,063,132 | Proud et al | Dec. 13, 1977 |
| 4,065,701 | Haugsjaa et al | Dec. 27, 1977 |
| 4,070,603 | Regan et al | Jan. 24, 1978 |

PRIOR ART STATEMENT

The United States patents set forth hereinabove constitute prior art which includes, in the opinion of the applicant and their attorney, the closest prior art of which they are aware. This prior art statement shall not be construed as a representation that a search has been made or that no better art exists.

SUMMARY OF THE INVENTION

It is an object of the present invention to provide new and improved electrodeless light sources.

It is another object of the present invention to provide new and improved fluorescent light sources.

It is another object of the present invention to provide fluorescent light sources which have dimming capability.

It is another object of the present invention to provide fluorescent light sources in which the phosphor coated surface may be replaced.

It is another object of the present invention to provide electrodeless fluorescent light sources which do not emit radio frequency interference.

According to the present invention, an electromagnetic discharge apparatus includes an electrodeless lamp in a termination fixture and can include a source of power at high frequency. The electrodeless lamp has an envelope made of a substance transparent to ultraviolet radiation enclosing a fill material which emits ultraviolet radiation upon breakdown and excitation. The termination fixture has an outer envelope, an inner conductor and an outer conductor disposed around the inner conductor. The conductors have a first end adapted for coupling to a high frequency power source and a second end coupled to the electrodeless lamp so that said electrodeless lamp forms a termination load for the fixture and emits ultraviolet radiation when high frequency power is applied to said fixture. The outer envelope has a phosphor coating which emits visible light upon absorption of ultraviolet radiation and is coupled to and encloses the second end of the outer conductor.

In another embodiment of the present invention, an electromagnetic discharge apparatus includes an electrodeless lamp in a termination fixture and can include a source of power at high frequency. The electrodeless lamp has an envelope made of a light transmitting substance which is coated with a phosphor which emits visible light upon absorption of ultraviolet radiation. The envelope encloses a fill material which emits ultraviolet radiation upon breakdown and excitation. The termination fixture has an inner conductor and an outer conductor disposed around the inner conductor. The conductors have a first end adapted for coupling to a high frequency power source and a second end coupled to said electrodeless lamp so that said electrodeless lamp forms a termination load for the fixture. The phosphor coating emits visible light in response to excitation by ultraviolet radiation from said fill material which high frequency power is applied to the fixture.

DESCRIPTION OF THE PREFERRED EMBODIMENTS

For a better understanding of the present invention, together with other and further objects, advantages and capabilities thereof, reference is made to the following disclosure and appended claims in connection with the above-described drawings.

Figure 1:
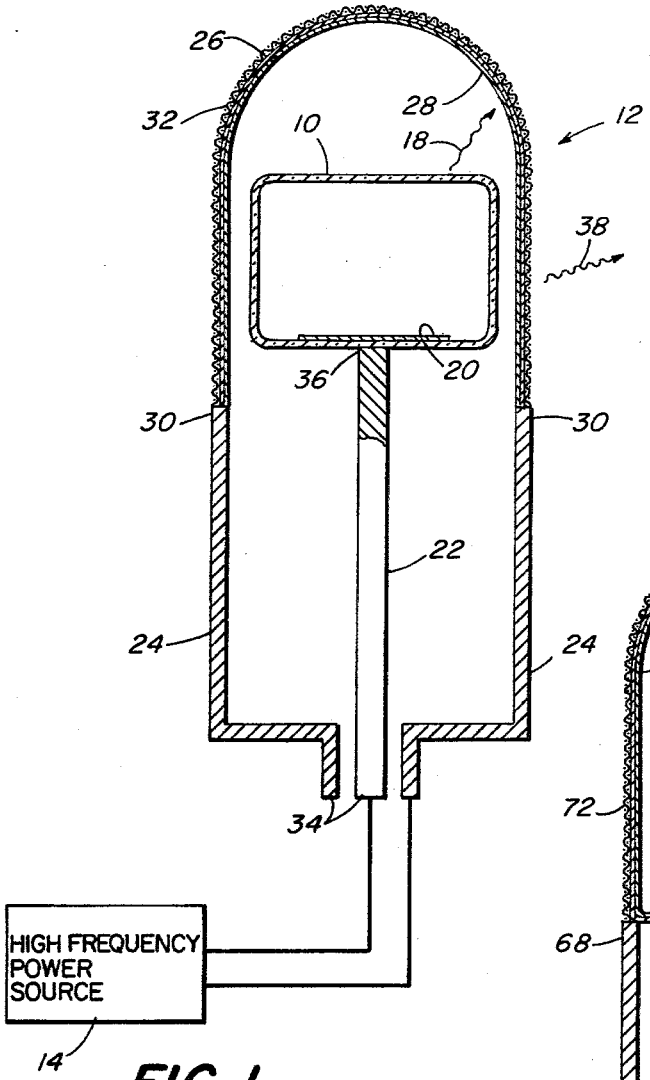
FIG. 1 is a diagram illustrating an electrodeless fluorescent light source according to the present invention.

In a preferred embodiment of the present invention, as shown in FIG. 1, an electromagnetic discharge apparatus includes an electrodeless lamp 10 mounted in a termination fixture 12. The discharge apparatus, more specifically an electrodeless fluorescent light source, can include a high frequency power source 14. As used in this disclosure high frequency power sources are those in the frequency range from 100 MHz to 300 GHz. Preferably, the frequency is in the ISM band (industrial scientific, and medical band) which ranges from 902 MHz to 928 MHz. One preferred frequency of operation is 915 MHz.

The electrodeless lamp 10 includes an envelope made of a substance capable of transmitting ultraviolet radiation, typically quartz. The envelope forms a closed shell which encloses a fill material which produces a low pressure glow discharge upon excitation. The glow discharge generates ultraviolet radiation. The fill material is typically a Penning mixture of mercury and an inert gas. For example, one fill mixture is 6 torr of neon with an excess of mercury. The envelope can have various shapes, but is typically cylindrical or spherical. In this embodiment, the electrodeless lamp 10 is not phosphor coated. The electrodeless lamp envelope can have an ultraviolet reflecting coating 20 on a portion of its inner surface to aid in directing all ultraviolet radiation 18 toward the phosphor coated surface of the termination fixture 12.

The termination fixture 12 includes an inner conductor 22 and an outer conductor 24. The outer conductor 24 is disposed around the inner conductor 22, typically in a coaxial configuration. The termination fixture 12 also includes a transparent envelope 26 with a phosphor coating 28 on its inner surface. The transparent envelope 26 is coupled to the second end 30 of the outer conductor 24 and has a conductive mesh 32 shown in FIG. 1 on the outer surface of the transparent envelope 26. The purpose of the mesh 32 is to provide effective shielding at the frequency of operation, thus preventing the emission of RFI from the termination fixture 12. In practice, the conductive mesh 32 can be either on the outer surface or the inner surface of the transparent envelope 26, or can be included in the envelope material, without changing the shielding effect. Measurements have shown that the conductive mesh 32 can reduce RFI to a level of 5 microwatts per square centimeter at a distance of 10 cm from the light source. However, the conductive mesh 32 must also provide minimum blockage of light output. Typically, the transparent envelope 26 is dome shaped and is made of glass. The phosphor coating 28 is one of the standard coatings commonly used in commercial fluorescent lamps. The inner conductor 22 and the outer conductor 24 each have a first end 34 which is adapted for coupling to a high frequency power source 14. The coupling to the high frequency power source is typically by coaxial cable. In an alternative configuration, the high frequency power source is incorporated into the base of the electrodeless light source as shown in U.S. Pat. No. 4,070,603, FIG. 1. It has been determined that the light source operates satisfactorily with a high frequency power source 14 which is modulated at 120 Hz, thus allowing the power source to be supplied from rectified 60 Hz ac line power. This feature permits a simplified power source design. The electrodeless lamp 10 is located at the second end 36 of the inner conductor 22 which can be adapted for mounting of the lamp. Impedance matching of the electrodeless lamp 10 to the high frequency power source 14 can be achieved by known configurations of the termination fixture 12. In one example, shown in U.S. Pat. No. 3,943,403, the inner conductor 22 has a length equal to one quarter wavelength at the operating frequency and a capacitor (not shown) is located at the source end of the fixture. In another example, shown in U.S. Pat. No. 3,943,404, a helical coil (not shown) couples the inner conductor 22 to the electrodeless lamp 10 and acts as an inductive matching component.

In operation, the glow discharge in the electrodeless lamp 10 is initiated when the high frequency power source 14 is turned on. High frequency power travels along the inner conductor 22 and causes ionization and breakdown within the electrodeless lamp 10. Ultraviolet radiation 18, which is produced by the glow discharge in the electrodeless lamp, is absorbed by the phosphor coating 28 on the inner surface of the transparent envelope 26 which in turn generates visible light 38. One advantage of the above-described configuration is that the phosphor surface is isolated from the hostile environment of the glow discharge, thus slowing degradation of the lumen output of the phosphor coating. In addition, the second end 30 of the outer conductor 24 can be adapted for easy removal of the transparent envelope 26 with the phosphor coating 28, for example, by snapping out. Thus, the phosphor coating 28 can be replaced when its lumen output degrades without the necessity for replacing the entire light source. A light source in accordance with the above-described embodiment of the invention gave a light output of 40.7 lumens per watt of high frequency power.

Figure 2:
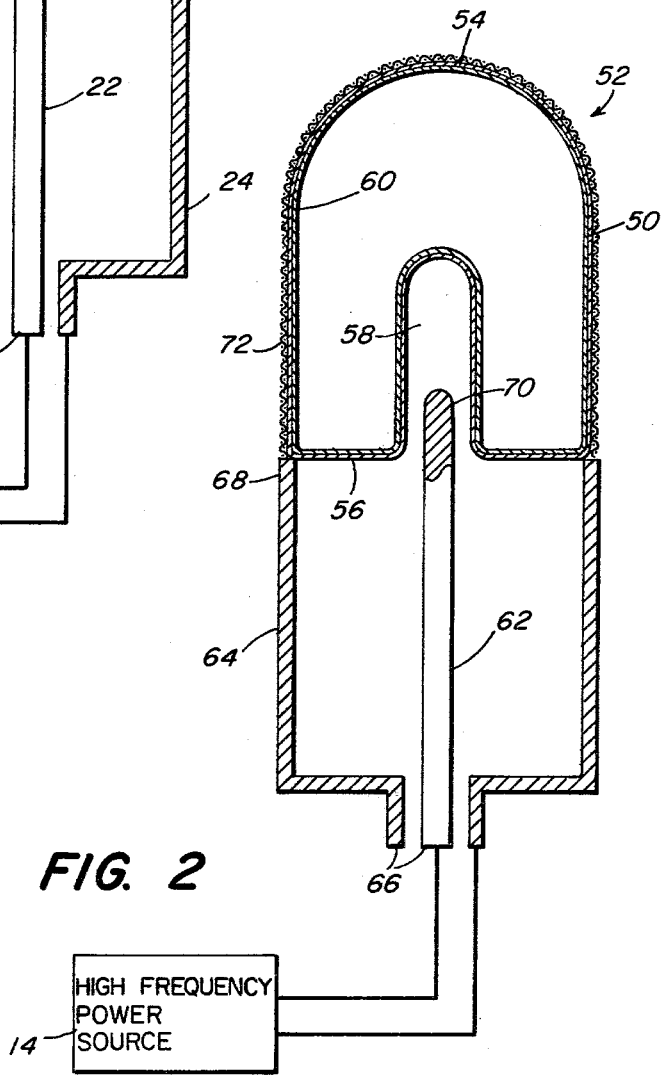
FIG. 2 is a diagram illustrating an alternative embodiment of an electrodeless fluorescent light source according to the present invention.

In another preferred embodiment of the present invention as shown in FIG. 2, an electromagnetic discharge apparatus includes an electrodeless lamp 50 mounted in a termination fixture 52. The discharge apparatus, more specifically an electrodeless fluorescent light source, can include a high frequency power source 14. The electrodeless lamp 50 includes an envelope made of a light transmitting substance. The envelope forms a closed shell which encloses a fill material which produces a low pressure glow discharge upon excitation. The glow discharge generates ultraviolet radiation. The fill material is typically a Penning mixture of mercury and an inert gas. For example, one fill mixture is 6 torr of neon with an excess of mercury. The envelope can have various shapes without departing from the scope of the invention. One exemplary shape is a reentrant cylinder which is defined for the purposes of this disclosure as follows.

Referring to the electrodeless lamp 50 in FIG. 2 which is in the shape of a reentrant cylinder, the cylinder has a first end 54 which is closed and a second end 56 which is closed but has a cylindrical cavity 58 of smaller diameter than the main cylinder extending into the main cylinder. One example of an electrodeless lamp having the shape of a reentrant cylinder has an overall length of 4.675 inches and an outside diameter of 2.0 inches with a wall thickness of 0.040 inch. The cavity extending into the main cylinder has a length of 4.0 inches and a diameter of 0.875 inch. The inner surface of the electrodeless lamp 50 has a phosphor coating 60. The phosphor coating 60 is one of the standard coatings commonly used in commercial fluorescent lamps and emits visible light upon excitation by ultraviolet radiation.

The termination fixture 52 includes an inner conductor 62 and an outer conductor 64. The outer conductor 64 is disposed around the inner conductor 62, typically in a coaxial configuration. The inner conductor 62 and the outer conductor 64 each have a first end 66 which is adapted for coupling to a high frequency power source 14. The coupling to the high frequency power source is typically by coaxial cable. In an alternative configuration, the high frequency power source is incorporated into the base of the electrodeless light source as shown in U.S. Pat. No. 4,070,603, FIG. 1. The high frequency power source 14 can be operated from full wave rectified 60 Hz ac power as above-described. The electrodeless lamp 50 is coupled to the second end 68 of the outer conductor 64 and the second end 70 of the inner conductor 62. Mechanical support for the electrodeless lamp 50 can be provided either by the inner conductor 62 or the outer conductor 64 depending on the configuration of the electrodeless lamp 50. In the embodiment illustrated in FIG. 2, the lamp 50 is mechanically coupled to the second end 68 of the outer conductor 64. Electrical coupling of high frequency power to the discharge is by the electric field at the second end 70 of the inner conductor 62. Laboratory studies of this configuration have shown that the shape and position of the center conductor affect the efficiency of operation. For example, it was found that one position for efficient operation is obtained if the second end 70 of the inner conductor 62 protrudes into the cylindrical cavity 58 in the electrodeless lamp 50 by a distance of approximately 2 cm. Impedance matching of the electrodeless lamp 50 to the microwave power source 14 can be achieved by the techniques above-described and shown in U.S. Pat. Nos. 3,943,403 and 3,943,404.

In the present embodiment of the invention, the electrodeless lamp 50 acts as the light transmitting portion of the termination fixture 52 with no additional outer envelope required. The conductive mesh 72, which provides shielding as hereinbefore described, is shown in FIG. 2 disposed around the outer surface of the electrodeless lamp 50. In operation, high frequency power flows from the source 14 along the inner conductor 62 and forms a strong electric field at the second end 70 of the inner conductor 62 which causes excitation and breakdown of the electrodeless lamp 50 fill material. The low pressure glow discharge emits ultraviolet radiation which in turn is absorbed by the phosphor coating 60 and visible light is emitted by the phosphor. An electrodeless fluorescent light source constructed in accordance with the present embodiment has an output of approximately 80 lumens per watt of high frequency power at 20 watts of 915 MHz input power.

One interesting feature of the present invention is that the light output can be reduced by varying the level of input high frequency power, thus providing a dimming capability. The input high frequency power level can be varied by any convenient means, for example, by varying the dc voltage to the power source or by inserting a variable attenuator in series with the power source output. Experiments have shown that the electrodeless fluorescent light source output can be reduced to 20% of its full lumen output.

Another feature of the electrodeless fluorescent light source is that the problems of starting are minimal in comparison with the problems of starting high pressure electrodeless lamps. After ionization and breakdown, the transition to steady state light output and steady state lamp impedance is quite rapid, thus eliminating impedance matching problems during warm up. In addition, laboratory studies have shown that repeatable starting and restarting of the discharge can be obtained immediately after turning off the electrodeless fluorescent light source.

While there has been shown and described what is at present considered the preferred embodiments of the invention, it will be obvious to those skilled in the art that various changes and modifications may be made therein without departing from the scope of the invention as defined by the appended claims.

What is claimed is:

1. An electromagnetic discharge apparatus comprising:

an electrodeless lamp having an envelope made of a substance transparent to ultraviolet radiation enclosing a fill material which emits ultraviolet radiation upon breakdown and excitation; and a termination fixture having an outer envelope, an inner conductor and an outer conductor disposed around the inner conductor, the conductors having a first end adapted for coupling to a high frequency power source and a second end coupled to said electrodeless lamp so that said electrodeless lamp forms a termination load for said fixture and emits ultraviolet radiation when high frequency power is applied to said fixture, said outer envelope having a phosphor coating which emits visible light upon absorption of ultraviolet radiation and being coupled to and enclosing the second end of said outer conductor.

2. The electromagnetic discharge apparatus according to claim 1 wherein said fill material is said electrodeless lamp includes mercury and at least one inert gas.

3. The electromagnetic discharge apparatus according to claim 1 wherein said outer envelope of said termination fixture is easily removable from said termination fixture.

4. The electromagnetic discharge apparatus according to claim 1 further including a source of power at high frequency coupled to the first end of said conductors.

5. The electromagnetic discharge apparatus according to claim 4 wherein the source of power at high frequency is in the range from 100 MHz to 300 GHz.

6. The electromagnetic discharge apparatus according to claim 4 wherein the source of power at high frequency is in the range from 902 MHz to 928 MHz.

7. The electromagnetic discharge apparatus according to claim 4 wherein said source of power at high frequency further includes a means for adjusting output power to provide dimming of the visible light output.

8. An electromagnetic discharge apparatus comprising:

an electrodeless lamp having an envelope made of a light transmitting substance said envelope having a phosphor coating which emits visible light upon absorption of ultraviolet radiation and, said envelope enclosing a fill material which emits ultraviolet radiation upon breakdown and excitation; and a termination fixture having an inner conductor and an outer conductor disposed around the inner conductor, the conductors having a first end adapted for coupling to a high frequency power source and a second end coupled to said electrodeless lamp so that said electrodeless lamp forms a termination load for said fixture and said phosphor coating emits visible light in response to excitation by ultraviolet radiation from said fill material when high frequency power is applied to said fixture.

9. The electromagnetic discharge apparatus according to claim 8 wherein said fill material in said electrodeless lamp includes mercury and at least one inert gas.

10. The electromagnetic discharge apparatus according to claim 8 wherein said electrodeless lamp has the shape of a reentrant cylinder.

11. The electromagnetic discharge apparatus according to claim 8 further including a source of power at high frequency coupled to the first end of said termination fixture.

12. The electromagnetic discharge apparatus according to claim 11 wherein the source of power at high frequency is in the range from 100 MHz to 300 GHZ.

13. The electromagnetic discharge apparatus according to claim 11 wherein the source of power at high frequency is in the range from 902 MHz to 928 MHz.

14. The electromagnetic discharge apparatus according to claim 11 wherein said source of power at high frequency further includes a means for adjusting output power to provide dimming of the visible light output.

* * * * *